US010150138B1

(12) United States Patent
Haag et al.

(10) Patent No.: US 10,150,138 B1
(45) Date of Patent: Dec. 11, 2018

(54) INTERFACE FOR INSERTING BONDING MATERIAL BETWEEN THE JOINS OF TWO INTERLOCKING MEMBERS

(71) Applicants: Roger Thomas Haag, Sahuarita, AZ (US); Carol Ann Haag, Sahuarita, AZ (US)

(72) Inventors: Roger Thomas Haag, Sahuarita, AZ (US); Carol Ann Haag, Sahuarita, AZ (US)

( * ) Notice: Subject to any disclaimer, the term of this patent is extended or adjusted under 35 U.S.C. 154(b) by 0 days.

(21) Appl. No.: 15/597,004

(22) Filed: May 16, 2017

(51) Int. Cl.
*B05C 17/005* (2006.01)

(52) U.S. Cl.
CPC .... *B05C 17/00569* (2013.01); *B05C 17/0052* (2013.01)

(58) Field of Classification Search
USPC ..... 156/71, 304.1, 304.5, 305, 307.1, 307.3, 156/546, 578; 428/53
See application file for complete search history.

(56) References Cited

U.S. PATENT DOCUMENTS 2,082,978 A * 6/1937 Robertson ..... E01C 11/126 404/48
2,119,355 A * 5/1938 Robertson ..... E01C 11/08 404/56
2,181,623 A * 11/1939 Klein ..... E01C 11/14 404/63
2,447,916 A * 8/1948 Staggers ..... E04B 2/10 52/436
2,815,656 A * 12/1957 Klein ..... E01F 8/0023 52/169.1
2,906,113 A * 9/1959 Engwall ..... E04B 1/41 52/489.2
3,119,204 A * 1/1964 Williams ..... E04B 1/6812 404/64
3,280,522 A * 10/1966 Palfey ..... E04B 1/6183 52/127.9
3,347,515 A * 10/1967 White ..... E01C 19/504 249/9
3,375,763 A * 4/1968 Welch ..... E01C 11/126 14/73.1
3,785,741 A * 1/1974 Lodige ..... E01C 11/14 404/51
4,015,383 A * 4/1977 Crowley ..... E04H 7/20 52/169.4

(Continued)

*Primary Examiner* — Sing P Chan
(74) *Attorney, Agent, or Firm* — RG Patent Consulting, LLC; Rachel Gilboy

(57) ABSTRACT

To increase the strength and water resistance of a joint between two slabs of building materials, an interface for inserting bonding material between the joins of two interlocking members is used. The interface has two interlocking slabs, a tongue ridge, a groove slot, a fill channel, and a quantity of adhesive. The two interlocking slabs are the pieces of building material that are joined by the interface. To accomplish this, the tongue ridge connects to the first interlocking slabs, and the groove slot traverses into the second interlocking slab. The tongue ridge engages the groove slot to form an interlocking connection. The fill channel traverses through the tongue ridge along the length of the tongue ridge so that the quantity of adhesive can be deposited into the interlocking connection between the tongue ridge and the groove slot.

18 Claims, 8 Drawing Sheets

(56) References Cited

U.S. PATENT DOCUMENTS

| | | | | | |
|---|---|---|---|---|---|
| 4,290,246 | A * | 9/1981 | Hilsey | E02D 27/02 | 52/125.3 |
| 4,635,418 | A * | 1/1987 | Hobgood | A47B 47/042 | 160/135 |
| 5,493,838 | A * | 2/1996 | Ross | E02D 29/05 | 405/229 |
| 5,701,708 | A * | 12/1997 | Taraba | E04B 1/14 | 52/210 |
| 5,743,056 | A * | 4/1998 | Balla-Goddard | E04B 1/14 | 52/127.9 |
| 6,253,530 | B1 * | 7/2001 | Price | E04B 1/12 | 156/71 |
| 7,409,976 | B2 * | 8/2008 | Chevalier | B31B 50/00 | 156/356 |
| 8,387,328 | B2 * | 3/2013 | Gentil | E04G 21/142 | 403/291 |
| 8,429,873 | B2 * | 4/2013 | Devine, Jr. | E04B 1/14 | 52/284 |
| 8,567,148 | B2 * | 10/2013 | Gentil | E04G 21/142 | 403/12 |
| 9,212,462 | B2 * | 12/2015 | Borel | E02D 17/13 | |
| 9,234,349 | B1 * | 1/2016 | Daiber | E04C 2/06 | |
| 9,896,838 | B2 * | 2/2018 | Daiber | E04B 2/34 | |
| 2006/0049065 | A1 * | 3/2006 | Chevalier | B31B 50/00 | 206/216 |
| 2008/0263981 | A1 * | 10/2008 | O'Brien | E01C 11/106 | 52/396.02 |
| 2011/0192107 | A1 * | 8/2011 | Farquhar | E04B 1/04 | 52/582.2 |
| 2012/0174521 | A1 * | 7/2012 | Schulte | E04F 13/08 | 52/588.1 |
| 2017/0175382 | A1 * | 6/2017 | Rogers | E04B 1/4114 | |

* cited by examiner

INTERFACE FOR INSERTING BONDING MATERIAL BETWEEN THE JOINS OF TWO INTERLOCKING MEMBERS

FIELD OF THE INVENTION

The present invention relates generally to a connection mechanism for slabs of building material. More specifically, the present invention relates to a modified tongue and groove connection that is designed with an internal channel into which an adhesive is pumped, thereby filling any voids that may exist between two slabs of material that are bonded together.

BACKGROUND OF THE INVENTION

The process of building structures from preformed slabs has become quite commonplace on construction sites. This technique increases efficiency by reducing construction time, cutting down on the amount of materials need for a job, and limiting the chance of something going wrong. The preformed slabs are generally formed with interlocking edges, which makes it easy to join two or more of the preformed slabs when building a structure. Once a construction worker connects the interlocking edges of two or more preformed slabs, the typical process for securing the connection is to apply grout, or some other bonding material, to the surface of the interlocking connection. While this is the generally accepted method, it creates joins that have empty spaces between the two connected preformed slabs. These empty spaces cause the join to lack durability and prevent the join from being truly waterproof.

The present invention, an interface for inserting bonding material between the joins of two interlocking members, addresses this concern by pumping a quantity of adhesive into the empty space between the two connected preformed slabs. To accomplish this, the present invention makes use of an interlocking connection between two preformed slabs that has a channel into which a bonding compound can be pumped. This channel enables the bonding material to flow through the interior of the interlocking connection and fill up any empty spaces that exist. By filling up the empty spaces between the two preformed slabs, the present invention increases the strength of the connection and prevents fluids from leaking through the connection.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 8, the preferred embodiment of the present invention, the interface for inserting bonding material between the joins of two interlocking members, is a tongue and groove connection system that is used to increase the strength of a bond between two slabs of material. To accomplish this, the present invention makes use of a modified tongue and groove connection. Specifically, the present invention makes use of a channel that traverses through the tongue and groove connection. Thus, enabling a quantity of bonding material to be pumped into any voids that may exist between the two slabs of material after they have been bonded together. The addition of the supplementary quantity of bonding material increases the strength of the bond and prevents liquids from seeping through the two slabs of material.

Figure 1:
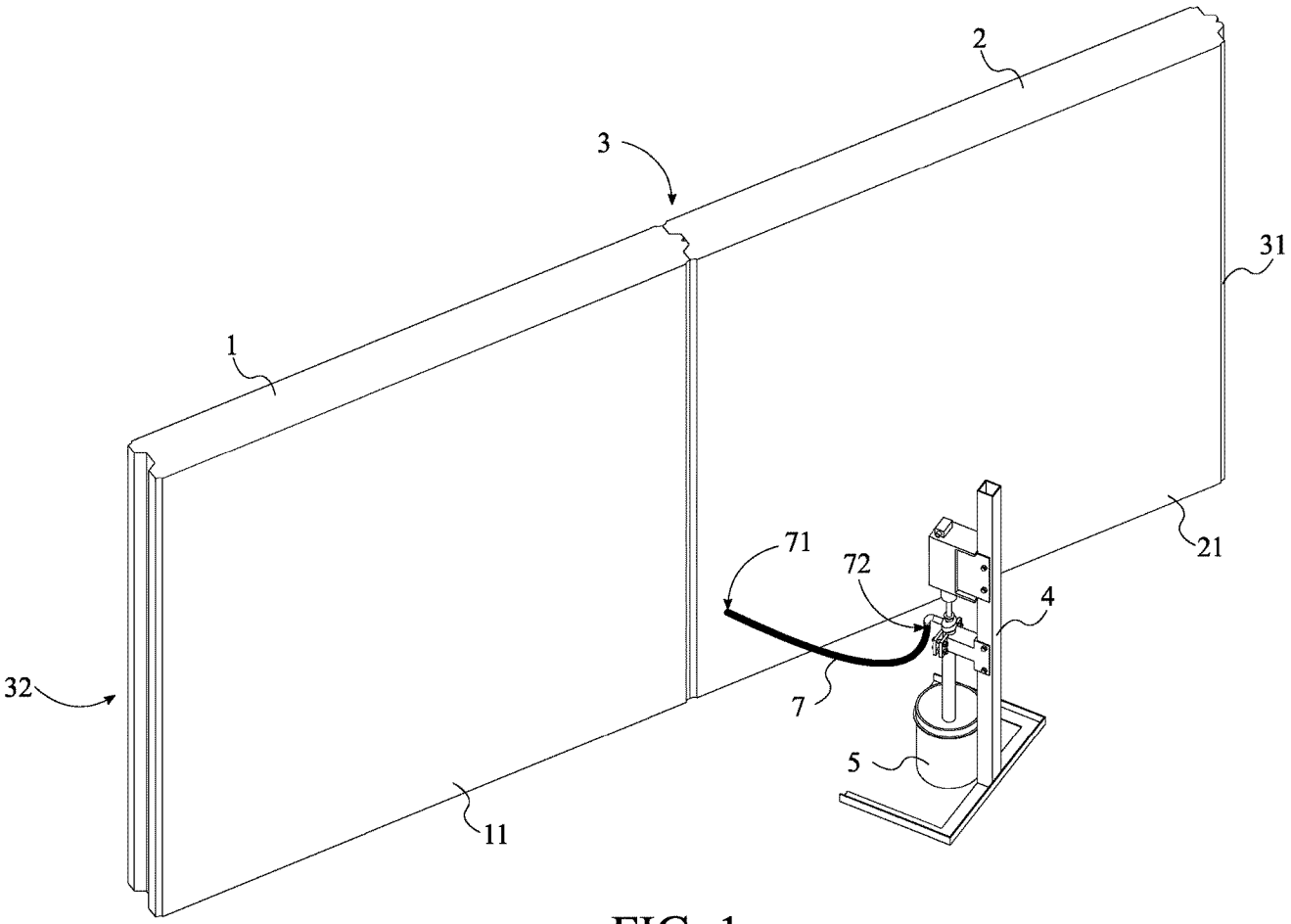
FIG. 1 is a perspective view of the present invention.
Figure 2:
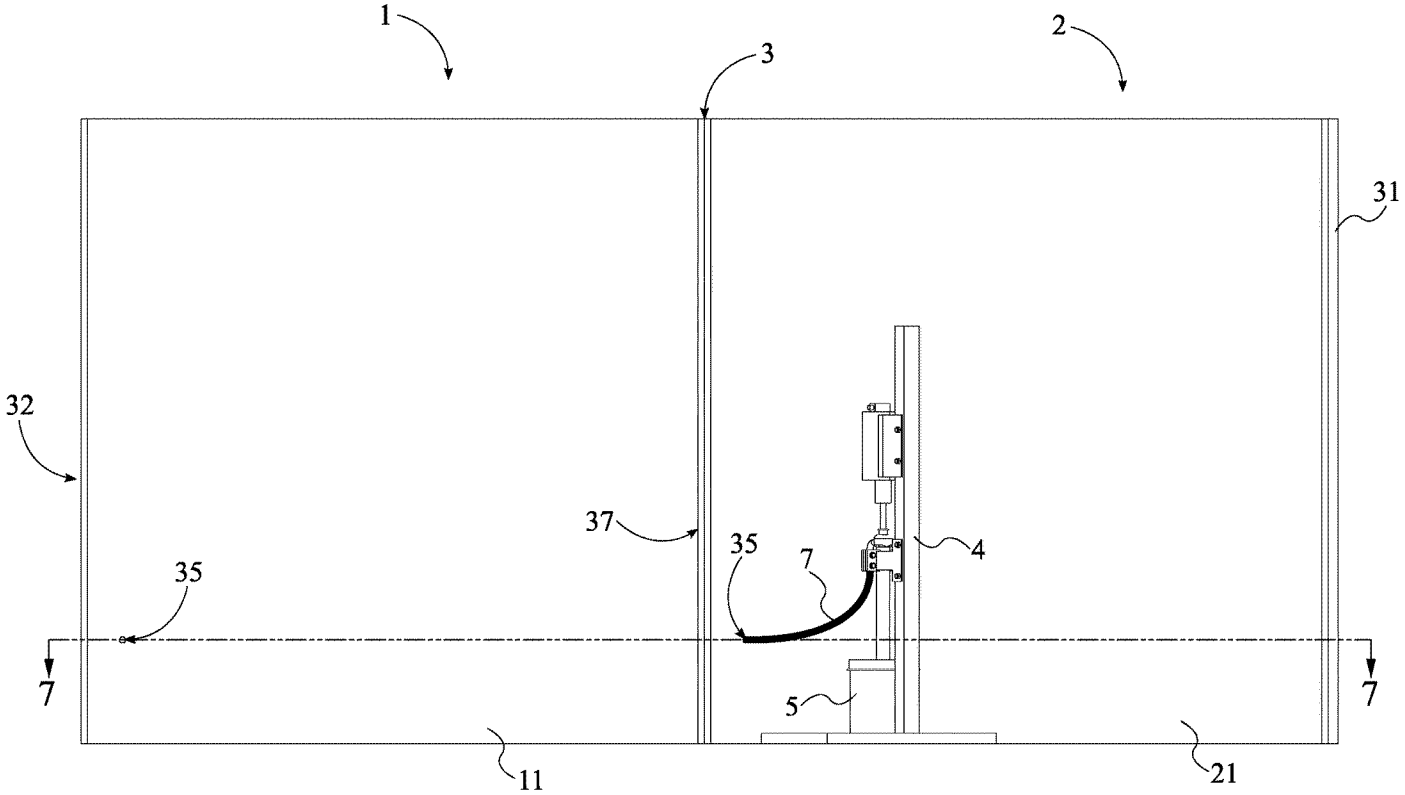
FIG. 2 is a front view of the present invention.
Figure 3:
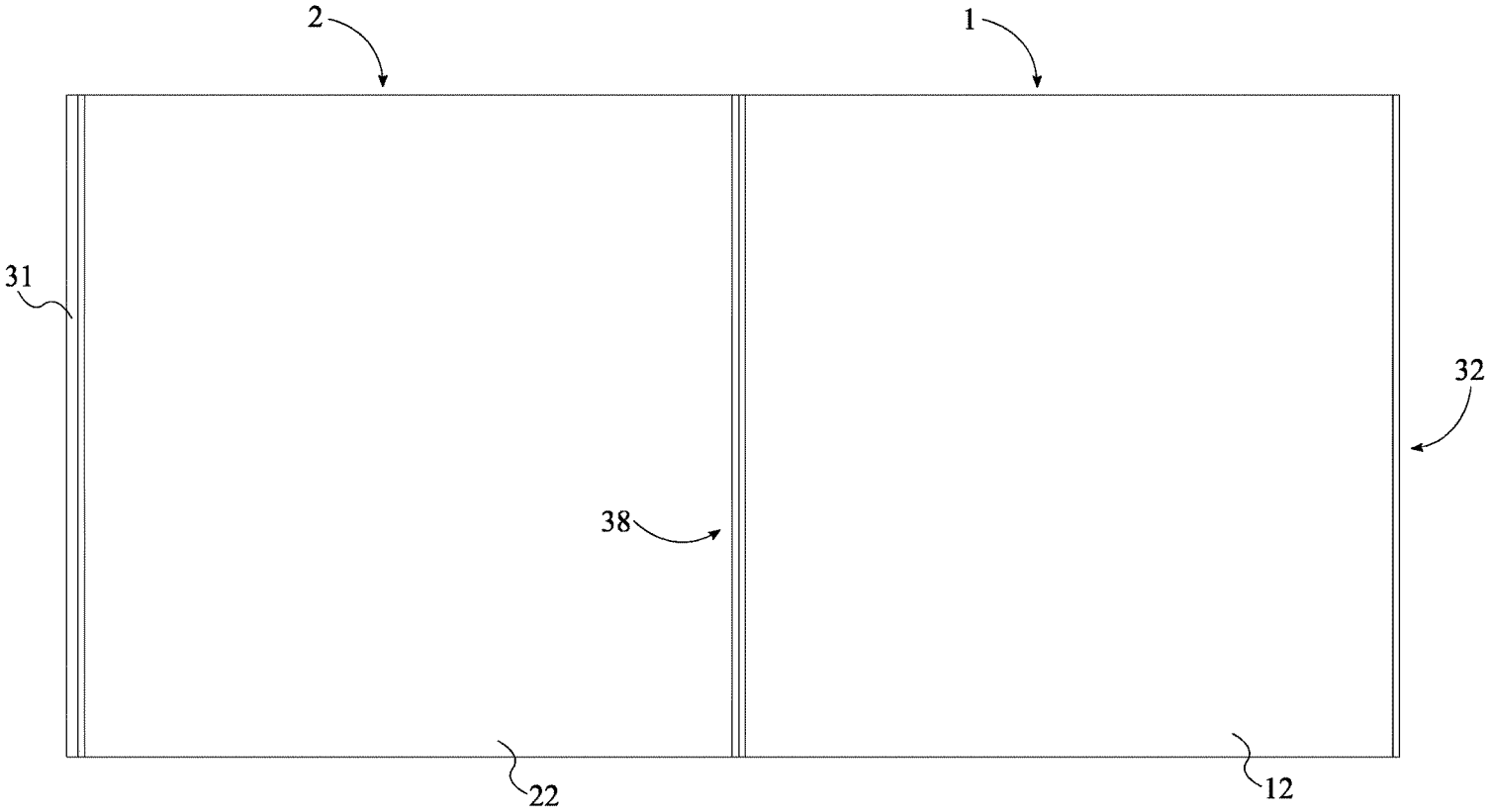
FIG. 3 is a rear view of the present invention.
Figure 4:
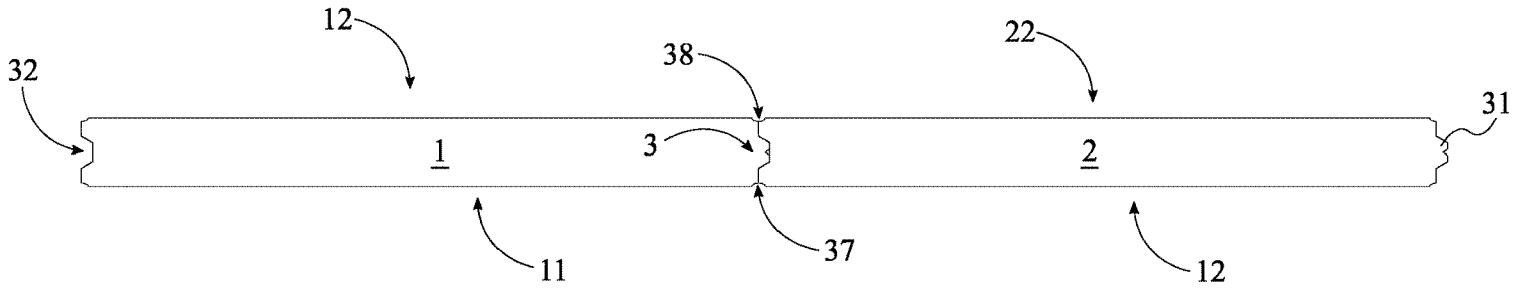
FIG. 4 is a top view of the present invention.
Figure 5:
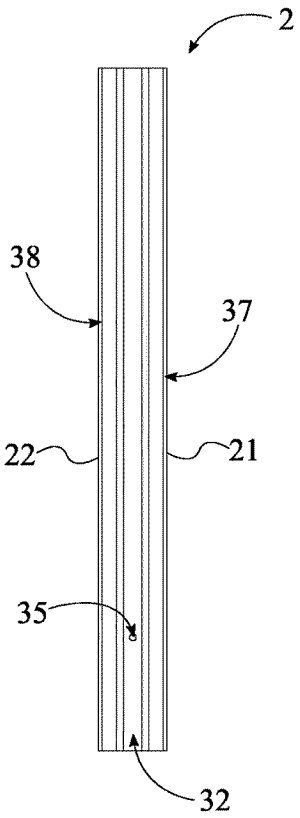
FIG. 5 is a left-side view of the second interlocking slab used in the present invention.
Figure 6:
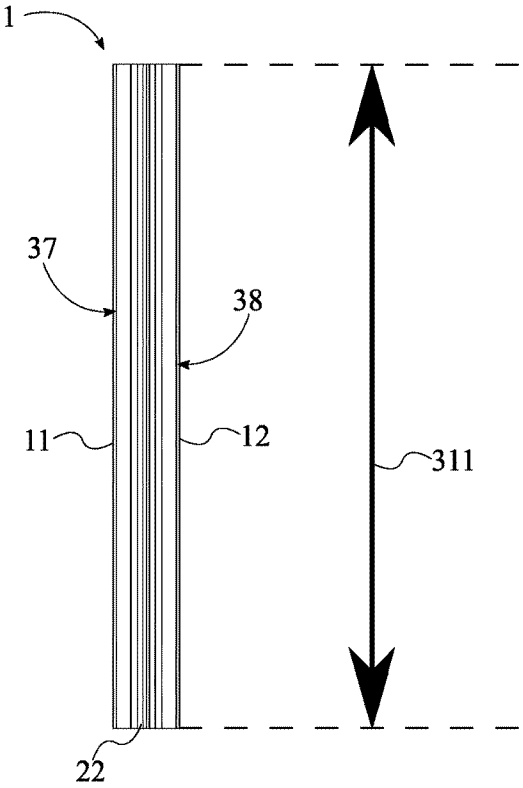
FIG. 6 is a right-side view of the first interlocking slab used in the present invention.
Figure 7:
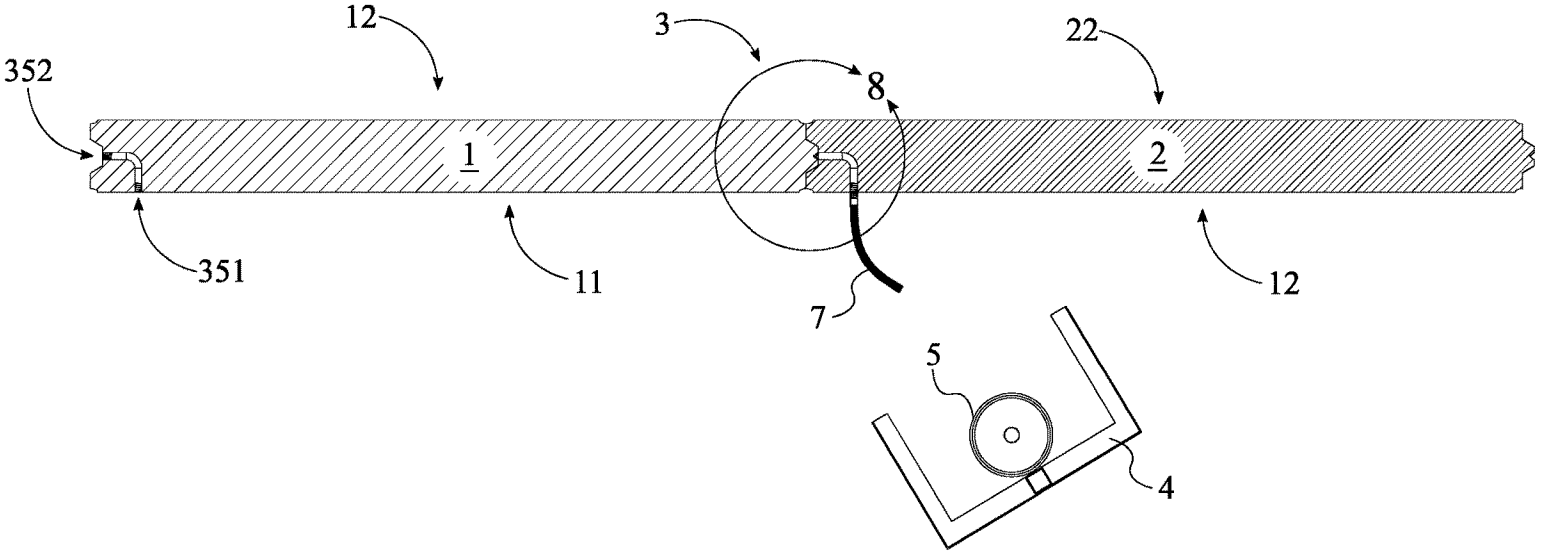
FIG. 7 is a top section view of the present invention taken along line 7-7 in FIG. 2.
Figure 8:
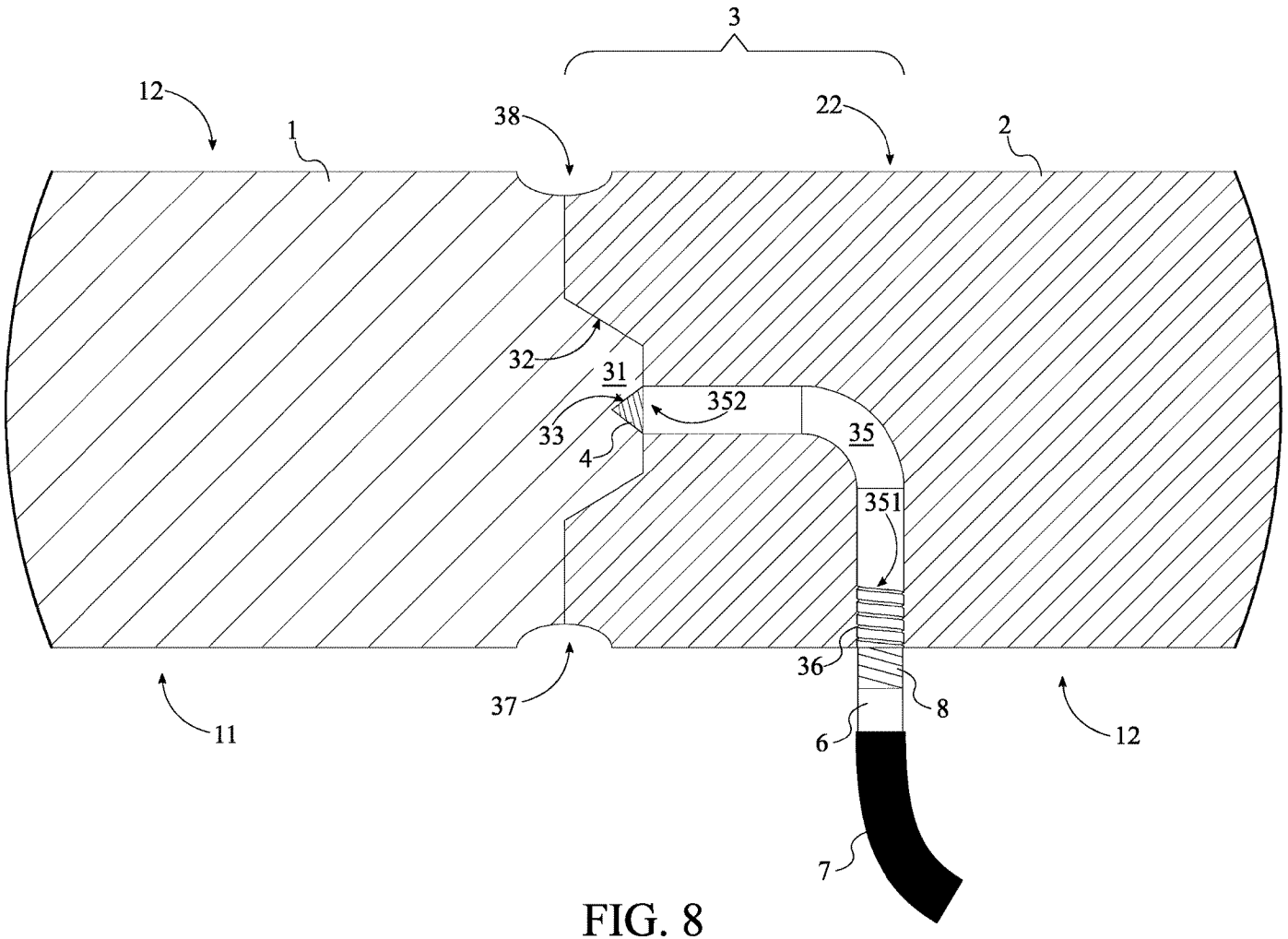
FIG. 8 is a detailed view of the present invention taken along line 8-8 in FIG. 7.

In reference to FIG. 1, FIG. 6, and FIG. 8, to achieve the above described functionality, the present invention comprises a first interlocking slab 1, a second interlocking slab 2, and a slab interface 3. The first interlocking slab 1 and the second interlocking slab 2 are slabs used to construct structures and are made from materials, including, but not limited to, concrete, wood, plastic, ceramics, and aluminum. The slab interface 3 is the connection mechanism used to bond the first interlocking slab 1 to the second interlocking slab 2. Additionally, the slab interface 3 comprises a tongue ridge 31, a groove slot 32, a fill channel 33, and a quantity of adhesive 34. As such, the tongue ridge 31 is adjacently connected to the first interlocking slab 1 so that the tongue ridge 31 is able to function as the tongue component of the modified tongue and groove connection between the first interlocking slab 1 and the second interlocking slab 2. The fill channel 33 traverses into the tongue ridge 31, opposite to the first interlocking slab 1 and perpendicular to a length 311 of the tongue ridge 31. Consequently, the fill channel 33 forms cavity into which the quantity of adhesive 34 is deposited. Additionally, the fill channel 33 traverses through the tongue ridge 31, parallel to the length 311 of the tongue ridge 31. As a result, the fill channel 33 forms a pathway through which the quantity of adhesive 34 is able to flow along the length of the joint between the first interlocking slab 1 and the second interlocking slab 2.

In reference to FIG. 8, the groove slot 32 traverses into the second slab. Thus positioned, the groove slot 32 is a receptacle for the tongue ridge 31. The tongue ridge 31 engages into the groove slot 32. Accordingly, the tongue ridge 31 and the groove slot 32 form the interlocking connection between the first interlocking slab 1 and the second interlocking slab 2. Finally, the quantity of adhesive 34 is retained within the fill channel 33 and the engagement between the tongue ridge 31 and the groove slot 32. Consequently, the quantity of adhesive 34 is able to flow into any voids that may exist in between the first interlocking slab 1 and the second interlocking slab 2. A portion of the quantity of adhesive 34 is allowed to seep out of the fill channel 33 and into the surrounding area between the first interlocking slab 1, the second interlocking slab 2. Additionally, another portion of the quantity of adhesive 34 is allowed to seep onto the surface on which the first interlocking slab 1, the second interlocking slab 2 rest. The quantity of adhesive 34 material is preferably made of an elastomeric membrane. However, the quantity of adhesive can use materials that include, but are not limited to, polyurethane, Chevron Industrial Membrane (CIM) 1000, and a concrete slurry.

In reference to FIG. 8, expounding upon the functionality of the present invention, the slab interface 3 further comprises a pumping channel 35 is to enable an external pumping mechanism to deliver the quantity of adhesive 34 into the fill channel 33. To that end, the pumping channel 35 traverses through the second interlocking slab 2 and into the groove slot 32 so that the quantity of adhesive 34 can flow into a desired area within the slab interface 3. Additionally, the pumping channel 35 is in fluid communication with the fill channel 33. Consequently, the quantity of adhesive 34 being supplied by an external pumping mechanism is able to flow through the pumping channel 35 and into the fill channel 33.

Further describing the components of the slab interface 3, an inlet 351 of the pumping channel 35 traverses out of a first face 21 of the second interlocking slab 2. As a result, the external pumping mechanism is able to deliver the quantity of adhesive 34 to the pumping channel 35 through the inlet 351. The slab interface 3 further comprises a female threading 36 that is used to connect male threaded fasteners to the slab interface 3. To that end, the female threading 36 is integrated into the inlet 351 of the pumping channel 35. Thus positioned, the female threading 36 enables the external pumping mechanism with a male threaded connector to be attached to the pumping channel 35. Thereby enabling the external pumping mechanism to deliver the quantity of adhesive 34 to the fill channel 33, through the pumping channel 35. Finally, an outlet 352 of the pumping channel 35 traverses out of the groove slot 32 and into the fill channel 33. Accordingly, the outlet 352 maintains the pumping channel 35 in fluid communication with the fill channel 33.

In the preferred embodiment of the present invention, a transversal cross section of the fill channel 33 is a triangular shape. The triangular shape of the fill channel 33 is used to create a fill channel 33 that minimizes the amount of empty space between the tongue ridge 31 and the groove slot 32. A transversal cross section of the tongue ridge 31 is a convex trapezoidal shape. The shape of the tongue ridge 31 is designed to correspond to the shape of the groove slot 32 so that lateral displacement of the first interlocking slab 1 relative to the second interlocking slab 2 is inhibited. To that end, a transversal cross section of the groove slot 32 is a concave trapezoidal shape. This concave trapezoidal shape enables the groove shot to function as a receptacle for the tongue ridge 31.

In reference to FIG. 1 and FIG. 8, in the present invention, the first interlocking slab 1 and the second interlocking slab 2 are designed with a first caulk-receiving crevice 37 and a second caulk-receiving crevice 38 into which a caulking material is deposited. The caulk material deposited into the first caulk-receiving crevice 37 and the second caulk-receiving crevice 38 is used to form the initial bond between the first interlocking slab 1 and the second interlocking slab 2. To that end, the first caulk-receiving crevice 37 is integrated into the first interlocking slab 1 and the second interlocking slab 2 so that the caulking material is able to join a first face 11 of the first interlocking slab 1 to a first face 21 of the second interlocking slab 2. Similarly, the second caulk-receiving crevice 38 is integrated into the first interlocking slab 1 and the second interlocking slab 2. Consequently, the caulking material is able to join a second face 12 of the first interlocking slab 1 to a second face 22 of the second interlocking slab 2. The slab interface 3 is positioned in between the first caulk-receiving crevice 37 and the second caulk-receiving crevice 38. As a result, the slab interface 3 is able to able to form an interlocking adhesive bond between the first interlocking slab 1 and the second interlocking slab 2. Additionally, the slab interface 3 is positioned to distribute the quantity of adhesive 34 into any empty space that exists between the first interlocking slab 1 and the second interlocking slab 2.

In reference to FIG. 1 and FIG. 8, a system for implementing the interface for inserting bonding material between the joins of two interlocking members described herein further comprises a pump 4, an adhesive reservoir 5, and a valve 6. The pump 4 is a pumping mechanism that is used to move the quantity of adhesive 34 out of the adhesive reservoir 5 and into the fill channel 33. The adhesive reservoir 5 is a container that holds the quantity of adhesive 34 and is in fluid communication with the pump 4. Thus connected, the pump 4 provides the force required to supply the desired quantity of adhesive 34 to the slab interface 3. The pump 4 is in fluid communication with the fill channel 33 through the valve 6. Accordingly, the valve 6 is able to permit or restrict the flow of the quantity of adhesive 34 into the fill channel 33. A user of the present invention is able to open or close the valve 6 as desired. Additionally, the valve 6 is preferably a ball valve.

In reference to FIG. 1 and FIG. 8, the system for implementing the present invention further comprises a hose 7. The hose 7 is a hollow tube that is used to transfer fluid from the pump 4 to the valve 6. To that end, a first end 71 of the hose 7 is in fluid communication with the pump 4 so that the quantity of adhesive 34 exiting the pump 4 flows into the hose 7. A second end 72 of the hose 7 is in fluid communication with the valve 6. Consequently, the quantity of adhesive 34 that is supplied by the adhesive reservoir 5, flows through the pump 4, and into the hose 7, must pass through the valve 6 before entering the pumping channel 35 and being deposited in the fill channel 33. The system for implementing the present invention further comprises a nipple 8. The nipple 8 is a connector that is used to attach external devices to the pumping channel 35. To that end, the valve 6 is in fluid communication with the pumping channel 35, through the nipple 8. As a result, the valve 6 is able to be attached to the pumping channel 35 without restricting the flow of the quantity of adhesive 34.

Although the invention has been explained in relation to its preferred embodiment, it is to be understood that many other possible modifications and variations can be made without departing from the spirit and scope of the invention as hereinafter claimed.

What is claimed is:

1. An interface for inserting bonding material between the joins of two interlocking members comprises:

a first interlocking slab;

a second interlocking slab a slab interface;

the slab interface comprises a tongue ridge, a groove slot, a fill channel, and a quantity of adhesive;

the tongue ridge being adjacently connected to the first interlocking slab;

the fill channel traversing into the tongue ridge, opposite to the first interlocking slab and perpendicular to a length of the tongue ridge;

the fill channel traversing through the tongue ridge, parallel to the length of the tongue ridge;

the groove slot traversing into the second slab;

the tongue ridge engaging into the groove slot; and the quantity of adhesive being retained within the fill channel and the engagement between the tongue ridge and the groove slot.

2. The interface for inserting bonding material between the joins of two interlocking members as claimed in claim 1 comprises:

the slab interface further comprises a pumping channel;

the pumping channel traversing through the second interlocking slab and into the groove slot; and the pumping channel being in fluid communication with the fill channel.

3. The interface for inserting bonding material between the joins of two interlocking members as claimed in claim 2 comprises:

an inlet of the pumping channel traversing out of a face of the second interlocking slab.

4. The interface for inserting bonding material between the joins of two interlocking members as claimed in claim 2 comprises:

the slab interface further comprises a female threading; and the female threading being integrated into an inlet of the pumping channel.

5. The interface for inserting bonding material between the joins of two interlocking members as claimed in claim 2 comprises:

an outlet of the pumping channel traversing out of the groove slot and into the fill channel.

6. The interface for inserting bonding material between the joins of two interlocking members as claimed in claim 1 comprises:

a transversal cross section of the fill channel being a triangular shape;

a transversal cross section of the tongue ridge being a convex trapezoidal shape; and a transversal cross section of the groove slot being a concave trapezoidal shape.

7. The interface for inserting bonding material between the joins of two interlocking members as claimed in claim 1 comprises:

a first caulk-receiving crevice;

a second caulk-receiving crevice;

the first caulk-receiving crevice being integrated into the first interlocking slab and the second interlocking slab;

the second caulk-receiving crevice being integrated into the first interlocking slab and the second interlocking slab, opposite to the first caulk-receiving crevice; and the slab interface being positioned in between the first caulk-receiving crevice and the second caulk-receiving crevice.

8. A system of filling the interface for inserting bonding material between the joins of two interlocking members as claimed in claim 1 comprises:

a pump;

an adhesive reservoir;

a valve;

the adhesive reservoir being in fluid communication with the pump; and the pump being in fluid communication with the fill channel through the valve.

9. A system of filling the interface for inserting bonding material between the joins of two interlocking members as claimed in claim 8 comprises:

a hose;

a first end of the hose being in fluid communication with the pump; and a second end of the hose being in fluid communication with the valve.

10. A system of filling the interface for inserting bonding material between the joins of two interlocking members as claimed in claim 8 comprises:

a nipple; and the valve being in fluid communication with a pumping channel through the nipple.

11. An interface for inserting bonding material between the joins of two interlocking members comprises:

a first interlocking slab;

a second interlocking slab a slab interface;

the slab interface comprises a tongue ridge, a groove slot, a fill channel, a pumping channel, and a quantity of adhesive;

the tongue ridge being adjacently connected to the first interlocking slab;

the fill channel traversing into the tongue ridge, opposite to the first interlocking slab and perpendicular to a length of the tongue ridge;

the fill channel traversing through the tongue ridge, parallel to the length of the tongue ridge;

the groove slot traversing into the second slab;

the tongue ridge engaging into the groove slot;

the quantity of adhesive being retained within the fill channel and the engagement between the tongue ridge and the groove slot;

the pumping channel traversing through the second interlocking slab and into the groove slot;

the pumping channel being in fluid communication with the fill channel;

a transversal cross section of the fill channel being a triangular shape;

a transversal cross section of the tongue ridge being a convex trapezoidal shape; and a transversal cross section of the groove slot being a concave trapezoidal shape.

12. The interface for inserting bonding material between the joins of two interlocking members as claimed in claim 11 comprises:

an inlet of the pumping channel traversing out of a face of the second interlocking slab.

13. The interface for inserting bonding material between the joins of two interlocking members as claimed in claim 11 comprises:

the slab interface further comprises a female threading; and the female threading being integrated into an inlet of the pumping channel.

14. The interface for inserting bonding material between the joins of two interlocking members as claimed in claim 11 comprises:

an outlet of the pumping channel traversing out of the groove slot and into the fill channel.

15. The interface for inserting bonding material between the joins of two interlocking members as claimed in claim 11 comprises:

a first caulk-receiving crevice;

a second caulk-receiving crevice;

the first caulk-receiving crevice being integrated into the first interlocking slab and the second interlocking slab;

the second caulk-receiving crevice being integrated into the first interlocking slab and the second interlocking slab, opposite to the first caulk-receiving crevice; and the slab interface being positioned in between the first caulk-receiving crevice and the second caulk-receiving crevice.

16. The interface for inserting bonding material between the joins of two interlocking members as claimed in claim 11 comprises:

a pump;

an adhesive reservoir;

a valve;

the adhesive reservoir being in fluid communication with the pump; and the pump being in fluid communication with the fill channel through the valve.

17. The interface for inserting bonding material between the joins of two interlocking members as claimed in claim 16 comprises:

a hose;

a first end of the hose being in fluid communication with the pump; and a second end of the hose being in fluid communication with the valve.

18. The interface for inserting bonding material between the joins of two interlocking members as claimed in claim 16 comprises:

a nipple; and the valve being in fluid communication with the pumping channel through the nipple.

* * * * *